US011193083B2

(12) United States Patent
Khelidj et al.

(10) Patent No.: US 11,193,083 B2
(45) **Date of Patent: *Dec. 7, 2021**

(54) ALKYL CAPPED OIL SOLUBLE POLYMER VISCOSITY INDEX IMPROVING ADDITIVES FOR BASE OILS IN INDUSTRIAL LUBRICANT APPLICATIONS

(71) Applicant: Dow Global Technologies LLC, Midland, MI (US)

(72) Inventors: Nadjet Khelidj, Horgen (CH); Martin R. Greaves, Horgen (CH); Evelyn A. Zaugg-Hoozemans, Horgen (CH)

(73) Assignee: Dow Global Technologies LLC, Midland, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/500,789

(22) PCT Filed: Jul. 21, 2015

(86) PCT No.: PCT/US2015/041216
§ 371 (c)(1),
(2) Date: Jan. 31, 2017

(87) PCT Pub. No.: WO2016/018668
PCT Pub. Date: Feb. 4, 2016

(65) Prior Publication Data

US 2017/0218296 A1 Aug. 3, 2017

Related U.S. Application Data

(60) Provisional application No. 62/031,205, filed on Jul. 31, 2014.

(51) Int. Cl.

| | |
|---|---|
| ***C10M 145/34*** | (2006.01) |
| ***C10M 169/04*** | (2006.01) |
| *C10N 20/02* | (2006.01) |
| *C10N 30/02* | (2006.01) |
| *C10N 40/04* | (2006.01) |
| *C10N 40/08* | (2006.01) |
| *C10N 40/12* | (2006.01) |
| *C10N 40/30* | (2006.01) |
| *C10N 40/25* | (2006.01) |

(52) U.S. Cl.
CPC ..... *C10M 145/34* (2013.01); *C10M 169/04* (2013.01); *C10M 169/041* (2013.01); *C10M 2203/1025* (2013.01); *C10M 2205/003* (2013.01); *C10M 2205/0285* (2013.01); *C10M 2209/105* (2013.01); *C10M 2209/107* (2013.01); *C10M 2209/108* (2013.01); *C10M 2209/1075* (2013.01); *C10N 2020/02* (2013.01); *C10N 2030/02* (2013.01); *C10N 2040/04* (2013.01); *C10N 2040/08* (2013.01); *C10N 2040/12* (2013.01); *C10N 2040/252* (2020.05); *C10N 2040/30* (2013.01)

(58) Field of Classification Search
CPC ..... C10M 145/26; C10M 145/34; C10M 2209/103; C10M 2209/107; C10M 2209/1075
USPC ..... 508/579
See application file for complete search history.

(56) References Cited

U.S. PATENT DOCUMENTS

| | | | | |
|---|---|---|---|---|
| 3,634,244 | A | 1/1972 | Herold et al. | |
| 6,087,307 | A * | 7/2000 | Kaminski | C10M 107/00 508/223 |
| 9,546,335 | B2 * | 1/2017 | Obrecht | C10M 169/04 |
| 2010/0004151 | A1 * | 1/2010 | Bush | C10M 107/34 508/564 |
| 2012/0108482 | A1 * | 5/2012 | Greaves | C10M 107/34 508/579 |
| 2013/0017981 | A1 | 1/2013 | Bush | |
| 2014/0018273 | A1 * | 1/2014 | Zweifel | C10M 107/34 508/545 |

(Continued)

FOREIGN PATENT DOCUMENTS

| | | | |
|---|---|---|---|
| EP | 2691498 | * | 5/2017 |
| JP | 2007204451 | | 8/2007 |

(Continued)

OTHER PUBLICATIONS

International Search Report & Written Opinion for related PCT Application PCT/US2015/041216, dated Oct. 9, 2015 (12 pgs).

*Primary Examiner* — Ellen M McAvoy

(74) *Attorney, Agent, or Firm* — Brooks, Cameron & Huebsch, PLLC

(57) ABSTRACT

An industrial base oil formulation comprising a base oil, preferably a hydrocarbon base oil, having a kinematic viscosity of more than 100 centiStokes, preferably 150 centiStokes or more, at 40 degrees Celsius and an AC-OSP where the AC-OSP has the structure of Formula I: $R^1[O(R^2O)_n(R^3O)_mR^4]_p$ (I) where $R^1$ is an alkyl having from one to thirty carbons, $R^2$ and $R^3$ are independently selected from alkyl groups having three or four carbons and can be in block form or randomly combined, $R^4$ is an alkyl having from one to 18 carbon atoms, n and m are independently numbers ranging from zero to 20 provided that n+m is greater than zero and p is a number within a range of one to three; wherein the industrial base oil formulation has a kinematic viscosity of greater than 100 centiStokes, preferably 150 centiStokes or more, at 40 degrees Celsius is useful in a lubricant for mechanical devices.

14 Claims, No Drawings

(56) References Cited

U.S. PATENT DOCUMENTS

| | | | | |
|---|---|---|---|---|
| 2015/0119303 | A1* | 4/2015 | Guerin | C10M 145/00<br>508/287 |
| 2015/0275124 | A1* | 10/2015 | Greaves | C10M 169/041<br>508/579 |
| 2017/0211009 | A1* | 7/2017 | Khelidj | C10M 145/32 |
| 2017/0211010 | A1* | 7/2017 | Khelidj | C10M 145/34 |
| 2017/0226442 | A1* | 8/2017 | Sanson | C10M 107/34 |

FOREIGN PATENT DOCUMENTS

| | | |
|---|---|---|
| JP | 548-40803 | 12/2011 |
| JP | S48-37402 | 12/2011 |

* cited by examiner

ALKYL CAPPED OIL SOLUBLE POLYMER VISCOSITY INDEX IMPROVING ADDITIVES FOR BASE OILS IN INDUSTRIAL LUBRICANT APPLICATIONS

This application is a National Stage Application under 35 U.S.C. § 371 of International Application Number PCT/US2015/041216, filed Jul. 21, 2015 and published as WO 2016/018668 on Feb. 4, 2016, which claims the benefit to U.S. Provisional Application 62/031,205, filed Jul. 31, 2014, the entire contents of which are incorporated herein by reference in its entirety.

BACKGROUND OF THE INVENTION

Field of the Invention

The present invention relates to base oil formulations for use in industrial lubricant formulations, the base oil formulation comprising a base oil and an alkyl capped oil soluble polymer, use of such a lubricant formulation as a lubricant in industrial applications, and a method for improving the viscosity index and low temperature viscosity of a hydrocarbon base oil.

Introduction

Mechanical devices use lubricants in order to reduce wear of parts that move proximate to one another. However, a challenge is that mechanical devices may have to operate over a broad range of temperature that can be well below zero degrees Celsius (° C.) to well over 100° C. Lubricants typically change viscosity based on temperature during use. The extent to which a lubricant changes its viscosity over a change in temperature is the lubricant's Viscosity Index, which is derived from a calculation based on the kinematic viscosity of the engine oil at 40° C. and 100° C. Higher viscosity index values correspond to less change in viscosity over a temperature range. Lubricants having a high viscosity index are desirable so as to maintain a desirable viscosity over a broad temperature range. If the viscosity becomes too high, then it is difficult for the mechanical device to operate. If the viscosity becomes too low, then lubricating capability decreases and excessive wear can occur.

Viscosity index improvers are additives for lubricants that tend to reduce the change in lubricant viscosity over a temperature range. Typical viscosity index improvers include, for example, polyalkylmethacrylates (such as polymethylmethacrylates) and olefin block copolymers. Unfortunately, while viscosity index improvers can increase a lubricant's viscosity index, they also tend to increase the lubricant's viscosity at low temperature (0° C.). While it is important for an lubricant to form a film that is viscous enough to prevent wear, it is also important that the lubricant not be so viscous so as to cause high frictional losses due to excessive viscous drag due to the lubricant.

Industrial lubricants are one particular class of lubricants that serve as lubricants in heavy duty equipment such as industrial gears, wind turbines, compressors, tunnel boring equipment and hydraulics. Heavy equipment requires a higher viscosity lubricant than, for example, typical automotive applications. Hence, industrial lubricants contain a base oil that has a kinematic viscosity of greater than 100 centiStokes (cSt), often of 150 cSt or more, even 500 cSt or more, at 40 degrees Celsius (° C.) (an "industrial base oil"). Also, industrial lubricants tend to have less than ten weight-percent (wt %) additive (including co-base oils) based on total weight of the lubricant formulation.

It is desirable to identify a viscosity index improving additive for industrial base oils that also reduces the low temperature (0° C.) viscosity of the industrial base oil. Particularly valuable would be an additive that increases viscosity index of an industrial base oil by at least 10 points and/or increases viscosity index to a value of 130 or higher while still reducing the low temperature viscosity.

BRIEF SUMMARY OF THE INVENTION

The present invention provides a solution to the problem of providing an additive for industrial base oils that increases the viscosity index of the industrial base oil while at the same time lowers the low temperature (0° C.) viscosity of the industrial base oil. Moreover, the present invention provides an additive for industrial base oils that increase the viscosity index of the industrial base oil by at least 10 points and/or increases viscosity index to a value of 130 or higher while still reducing the low temperature viscosity.

Industrial lubricant base oils are characterized by having a kinematic viscosity of greater than cSt, preferably 150 cSt or more, at 40° C. Changes to viscosity index and kinematic viscosity of the base oil herein refer to a comparison of those properties for the pure industrial base oil to a formulation of the industrial base oil with an alkyl capped oil soluble polymer (AC-OSP), the combination of which is an industrial base oil formulation.

The present invention is a result of surprisingly and unexpectedly discovering that AC-OSPs serve as both highly effective viscosity index improvers and as highly effective low temperature viscosity reducing agents for industrial base oils.

In a first aspect, the present invention is an industrial base oil formulation comprising a base oil, preferably a hydrocarbon base oil, having a kinematic viscosity of more than 100 centiStokes, preferably 150 centiStokes or more, at 40 degrees Celsius and an AC-OSP where the AC-OSP has the structure of Formula I:

$$R^1[O(R^2O)_n(R^3O)_mR^4]_p \quad \text{(I)}$$

where $R^1$ is an alkyl having from one to thirty carbons, $R^2$ and $R^3$ are independently selected from alkyls having three or four carbons and can be in block form or randomly combined, $R^4$ is an alkyl having from one to 18 carbon atoms, n and m are independently numbers ranging from zero to 20 provided that n+m is greater than zero and p is a number within a range of one to three; wherein the industrial base oil formulation has a kinematic viscosity of greater than 100 centiStokes, preferably 150 cSt or more, and can be 200 cSt or more at 40 degrees Celsius.

In a second aspect, the present invention is a method for increasing the viscosity index of a base oil having a kinematic viscosity of more than 100 cSt at 40 degrees Celsius while simultaneously decreasing the viscosity of the base oil at a temperature of zero degrees Celsius, the method comprising blending into the base oil an AC-OSP where the AC-OSP has the structure of Formula I:

$$R^1[O(R^2O)_n(R^3O)_mR^4]_p \quad \text{(I)}$$

where $R^1$ is an alkyl having from one to thirty carbons, $R^2$ and $R^3$ are independently selected from alkyls having three or four carbons, $R^4$ is an alkyl having from one to 18, n and m are independently selected from numbers ranging from one to 20 provided that n+m is greater than zero and p is a number within a range of one to three so as to achieve the industrial lubricant base oil formulation of the first aspect.

In a third aspect, the present invention is a method for lubricating a mechanical device comprising multiple pats that move with respect to one another, the method comprising introducing the lubricant of the first aspect into the mechanical device so as to access interstices between the parts that move with respect to one another.

The industrial base oil formulation of the present invention is useful to prepare a lubricant for use in industrial machines such as compressors.

DETAILED DESCRIPTION OF THE INVENTION

"And/or" means "and, or alternatively". All ranges include endpoints unless otherwise stated.

Test methods refer to the most recent test method as of the priority date of this document unless a date is indicated with the test method number as a hyphenated two digit number. References to test methods contain both a reference to the testing society and the test method number. Test method organizations are referenced by one of the following abbreviations: ASTM refers to ASTM International (formerly known as American Society for Testing and Materials); EN refers to European Norm; DIN refers to Deutsches Institut für Normung; and ISO refers to International Organization for Standards.

Determine kinematic viscosity according to ASTM D7042. Determine viscosity index for a lubricant formulation according to ASTM D2270. Determine pour point according to ASTM D97.

"Industrial base oil" and "industrial lubricant base oil" are interchangeable terms and refer to a base oil having a kinematic viscosity (KV) of more than 100 centiStokes (cSt), preferably 150 cSt or more, at 40 debrees Celsius (° C.). The base oil can be a hydrocarbon base oil. Examples of industrial base oils include those sold under the trade names Spectrasyn™ 40 (396 cSt KV at 40° C.; Spectrasyn is a trademark of Exxon Mobil Chemical); Spectrasyn™ 100 (1208 cSt KV at 40° C.). Preferably, the base oil is a polyalphaolefin.

The present invention is an industrial base oil formulation, which is a combination of an industrial base oil and a particular AC-OSP. The AC-OSP has a structure as shown in Formula I:

$$R^1[O(R^2O)_n(R^3O)_mR^4]_p \quad (I)$$

$R^1$ is an alkyl having from one or more, preferably four or more, still more preferably six or more and can have eight or more, ten or more even twelve or more carbons while at the same time has thirty carbons or fewer, preferably 26 carbons or fewer and more preferably 24 carbons or fewer, and can have 20 carbons or fewer, 18 carbons or fewer, 16 carbons or fewer, 14 carbons or fewer or even 12 carbons or fewer. $R^2$ and $R^3$ are independently selected from alkyls having three or four carbons and can be the same or different. $R^4$ is an alkyl having from one or more and can have two or more and typically has 18 or fewer carbons. Subscripts n and m are independently (meaning they do not have to be the same) numbers ranging from zero to 20 provided that n+m is greater than zero. Subscript p is a number that is one or more and can be two or more and is typically three or lower. Preferably, p has a value of one, which would be the case when $R^1$ is the residual of a monol initiator used to prepare the AC-OSP during the polymerization of the alkylene oxides. For individual AC-OSP molecules, n, m and p are integer values yet for multiple molecules one or ordinary skill understands that the collection of molecules can have an average value for n, m and/or p that is not an integer. The average value of m, n and p for the AC-OSP molecules of the invention fall within the specified range.

The AC-OSP is selected from a group of 1,2-propylene oxide polymers, 1,2-butylene oxide polymer, random copolymers of 1,2-propylene oxide and 1,2-butylene oxide and block copolymers of 1,2-propylene oxide and 1,2-butylene oxide. For 1,2-propylene oxide and 1,2-butylene oxide copolymers the $OR^2$ and $OR^3$ components can be in block form with all $OR^2$ units occurring together in sequence and all $OR^3$ units occurring together in sequence or the copolymer can be random with $OR^2$ and $OR^3$ elements occurring in random order.

Generally, the AC-OSP has a molecular weight of 200 grams per mole (g/mol) and can have a molecular weight of 300 g/mol or more, 400 g/mole or more, 500 g/mol or more and even 600 g/mol or more while at the same time generally has a molecular weight of 700 g/mol or less and can have a molecular weight of 600 g/mol or less. Calculate the molecular weight for an AC-OSP from the molecular weight of the non-capped OSP and the molecular weight of the cap. Determine molecular weight in grams per mole (g/mol) for the non-capped OSP from the hydroxyl number. Determine hydroxyl number and molecular weight according to ASTM D4274. The molecular weight of the AC-OSP is then the molecular eight of the capping group plus the molecular weight of the non-capped OSP minus one. For example, capping an OSP with a methyl group would produce a capped OSP having a molecular weight equal to 15 g/mol for the methyl group, plus the molecular weight of the non-capped OSP, minus one g/mol due to loss of a hydrogen from the OSP upon replacement of the hydrogen with the capping group.

Generally, the industrial base oil formulation of the present invention comprises five weight percent (wt %) or more, preferably ten wt % or more and can comprise 15 wt % or more, while at the same time generally comprises 50 wt % or less, preferably 40 wt % or less, more preferably 30 wt % or less, still more preferably 20 wt % or less and can comprise 15 wt % or less or even 10 wt % or less alkyl capped oil soluble polymer based on the combined weight of industrial base oil and AC-OSP.

The industrial base oil formulation of the present invention can be further formulation with additional additives in combination with the industrial base oil and AC-OSP to form an industrial lubricant. Examples of suitable additional components include any one or any combination of more than one selected from a group consisting of antioxidants, corrosion inhibitors, viscosity index increasing agents, anti-wear additive, foam control agents, yellow metal passivators, extreme pressure additives, pour point depressants, friction reducing agents and/or dyes. Additional components are desirably soluble in the industrial base oil. Industrial base oil formulations are typically free of one or both of the following: detergents and dispersants. The lubricant formulation of the present invention typically contains less than ten wt %, preferably five wt % or less of total additives based on total industrial lubricant weight.

The present invention includes a method for increasing the viscosity index of an industrial base oil while simultaneously decreasing the viscosity of the base oil at a temperature of 0° C. The method comprises blending the AC-OSP with an industrial base oil to obtain the industrial base oil formulation of the present invention. The present invention has surprisingly discovered that AC-OSPs as described above can achieve this desirable result of increasing the viscosity index of the industrial base oil while at the same time decreasing the viscosity of the industrial base oil at a temperature of 0° C. In fact, the AC-OSPs are capable of increasing the viscosity index of the industrial base oil by 10 points or more and/or to a value of 130 or more.

The present invention also includes a method for lubricating an industrial mechanical device comprising multiple components that move with respect to one another by introducing a lubricant comprising the industrial base oil formulation of the present invention into the mechanical device so that the lubricant accesses interstices between the parts that move with respect to one another.

The industrial base oil formulation of the present invention offers the surprising advantage over other industrial base oils in that it has a higher viscosity index and a lower viscosity at a temperature of 0 C than the industrial base oil alone and can increase the viscosity index by at least 10 points and/or to a value of at least 130.

EXAMPLES

Table 1 identifies base oils for use in the present examples. Prepare the two experimental base oils (OSP-AC and OSP-BC) as follows.

OSP-AC

Load 1600 g of 2-ethyl-1-hexanol into a stainless steel reactor vessel followed by 11.3 g of 85 wt % aqueous potassium hydroxide and heat the mixture to 115° C. under a nitrogen blanket. Add a mixture of 2400 g 1,2-propylene oxide and 240 g 1,2-butylene oxide into the reactor at a temperature of 130° C. and a pressure of 500 kPa. Stir the mixture and allow it to digest for 12 hours at 130° C. Remove residual catalyst by filtration through a magnesium silicate filtration bed at a temperature of 50° C. to yield an intermediate having a kinematic viscosity at 40° C. of 17.7 cSt, at 40° C. and 3.81 cSt at 100° C. and a pour point of −59.0° C.

Load 5805 g of the intermediate into a stainless steel reactor vessel. Add 2604 g sodium methoxide solution (25 wt % sodium methoxide in methanol) and stir the mixture at 120° C. for 12 hours under a vacuum (below 45 kPa absolute pressure) with a nitrogen purge of 200 milliliters per minute and a stirring speed of 180 revolutions per minute. Feed 639 g of methyl chloride into the reactor at a temperature of 80° C. and a pressure of 170 kPa. Stir the mixture and allow to digest for one hour at 80° C. After the mixture digests, flash for 20 minutes at 80° C. and remove unreacted methyl chloride and dimethyl ether using a vacuum. Add 2133 g water and stir for one hour at 80° C. to wash the sodium chloride from the mixture. Stop the stirrer and allow to settle for 1.5 hours at 100° C. under vacuum and a pressure of less than one kPa with a nitrogen purge of 200 milliliters per minute and a stirrer speed of 180 revolutions per minute. Cool the resulting product to 60° C. and filter through a magnesium silicate filtration bed at 50° C. to yield a product (OSP-AC) that has a capping conversion of 98.9%, kinematic viscosity of 10.3 at 40° C. and 3.1 cSt at 100° C., a viscosity index of 173 and a pour point of −74.0° C.

OSP-BC

Load 2369 g of dodecanol initiator into a stainless steel reactor vessel followed by 20.02 g of 45 wt % aqueous potassium hydroxide and heat the mixture to 115° C. under a nitrogen blanket. Flash the mixture to remove water at 115° C. and three mega Pascals pressure until the water concentration is below 0.1 wt %. Feed a mixture of 1808.5 g 1,2-propylene oxide and 1808.5 g 1,2-butylene oxide into the reactor at a temperature of 130° C. and pressure of 490 kPa. Stir the mixture and allow it to digest for 14 hours at 130° C. Remove residual catalyst by filtration through a magnesium silicate filtration bed at 50° C. to yield a product (Intermediate B) having a kinematic viscosity of 16.1 cSt at 40° C., 3.7 cSt at 100° C. and a pour point of −39.0° C.

Load 5797 g of Intermediate B into a stainless steel reactor vessel. Add 2765 g of sodium methoxide solution (25 wt % in methanol) and stir at 120° C. for 12 hours at 80° C. under vacuum (less than one kPa) with nitrogen purging at 200 milliliters per minute and a stirring speed of 180 revolutions per minute. Discharge 3825 g of the mixture from the reactor. To the remaining 2264 g of mixture feed 252 g of methyl chloride at a temperature of 80° C. at a pressure of 260 kPa. Stir the mixture and allow it to digest for 1.5 hours at 80° C. After digesting the mixture, flash for 10 minutes at 80° C. under vacuum to remove unreacted methyl chloride and dimethyl ether. Add 796 g of water and stir for 40 minutes at 80 C to wash the sodium chloride from the mixture. Stop stirring and allow to settle for one hour at 80° C. Decant off 961 g of brine phase. Add 50 g of magnesium silicate to the remaining mixture and flash off residual water in one hour at 100° C. under vacuum (less than one kPa pressure) with nitrogen purging at 200 milliliters per minute and stirring rate of 180 revolutions per minute. Cool the resulting material to 60° C. and discharge 2218 grams and filter it through a magnesium silicate filtration bed at 50° C. to yield a product (OSP-BC) that has a capping conversion of 93.7%, kinematic viscosity of 9.9 cSt at 40° C., 3.0 cSt at 100° C. and a pour point of −45.0° C.

TABLE 1

| Base Oil | Description |
|---|---|
| OSP-18 | Alcohol initiated random copolymer of propylene oxide and butylene oxide (50/50 by weight) with a typical kinematic viscosity of 4 cSt at 100° C., average molecular weight of 500 g/mol and viscosity index of 123. For example UCON ™ OSP-18 (UCON is a trademark of Union Carbide Corporation). |
| OSP-32 | Alcohol initiated random copolymer of propylene oxide and butylene oxide (50/50 by weight) with a typical kinematic viscosity of 6.5 cSt at 100° C., average molecular weight of 760 g/mol and viscosity index of 146. For example UCON ™ OSP-32. |
| OSP-46 | Alcohol initiated random copolymer of propylene oxide and butylene oxide (50/50 by weight) with a typical kinematic viscosity of 8 cSt at 100° C., average molecular weight of 1000 g/mol and viscosity index of 164. For example UCON ™ OSP-18. |
| OSP-AC | Experimental base oil that is a 2-ethyl-1-hexanol initiated copolymer of propylene oxide and butylene oxide that is methyl capped. Kinematic viscosity of 10.3 cSt at 40° C. and 3.1 cSt at 100° C., pour point of −74° C. and viscosity index of 173. |

TABLE 1-continued

| Base Oil | Description |
|---|---|
| OSP-BC | Experimental base oil that is a Nacol 12-99 initiated copolymer of propylene oxide and butylene oxide that is methyl capped. Kinematic viscosity of 9.9 cSt at 40° C. and 3.0 cSt at 100° C., pour point of −45° C. and viscosity index of 183. |
| Grp III-1 | An API Group III mineral oil with a typical kinematic viscosity at 100° C. of 5 cSt and at 40° C. of 20 cSt. For example, Nexbase ™ 3043 (Nexbase is a trademark of Neste Oil OYJ Corporation. |
| Grp IV-1 | An API Group IV polyalphaolefin base oil with a typical kinematic viscosity at 100° C. of 4 cSt and at 40° C. of 16.8 cSt, viscosity index of 124 and a pour point of −69° C. For example, Synfluid ™ PAO-4 (Synfluid is a trademark of Chevron Philips Chemical Company LP). |
| Grp IV-2 | An API Group IV polyalphaolefin base oil with a typical kinematic viscosity at 100° C. of 4 cSt and at 40° C. of 19 cSt, viscosity index of 124 and a pour point of −69° C. For example, Spectrasyn ™ 4 (Spectrasyn is a trademark of Exxon Mobil Chemical). |
| Grp IV-3 | An API Group IV polyalphaolefin base oil with a typical kinematic viscosity at 100° C. of 40 cSt and at 40° C. of 396 cSt, viscosity index of 147 and a pour point of −36° C. For example, Spectrasyn ™ 40. |
| Grp IV-4 | An API Group IV polyalphaolefin base oil with a typical kinematic viscosity at 100° C. of 100 cSt and at 40° C. of 1240 cSt, viscosity index of 170 and a pour point of −30° C. For example, Spectrasyn ™ 100. |
| Grp IV-5 | An API Group IV polyalphaolefin base oil with a typical kinematic viscosity at 100° C. of 6 cSt and at 40° C. of 30 cSt, viscosity index of 139 and a pour point of −69° C. For example, Synfluid ™ PAO-6. |
| Grp IV-6 | An API Group IV polyalphaolefin base oil with a typical kinematic viscosity at 100° C. of 40 cSt and at 40° C. of 348 cSt, derived from metallocene catalyst. For example, Synfluid ™ m-PAO-40. |
| Grp IV-7 | An API Group IV polyalphaolefin base oil derived from a metallocene catalyst and having a typical kinematic viscosity at 100° C. of 100 cSt and at 40° C. of 992 cSt, viscosity index of 192 and a pour point of −44° C. For example, Synfluid ™ m-PAO-100. |
| Grp IV-8 | An API Group IV polyalphaolefin base oil derived from a metallocene catalyst and having a typical kinematic viscosity at 100° C. of 156 cSt and at 40° C. of 1705 cSt, viscosity index of 206 and a pour point of −33° C. For example, Spectrasyn ™ m-PAO-150. |
| Grp IV-9 | An API Group IV polyalphaolefin base oil derived from a metallocene catalyst and having a typical kinematic viscosity at 100° C. of 65 cSt and at 40° C. of 614 cSt, viscosity index of 179 and a pour point of −42° C. For example, Spectrasyn ™ Elite 65. |

Prepare base oil formulations by additing to a 200 milliliter (mL) glass beaker each component of the formulation as identified in Tables 2-7 to form a 100 g formulation. Each of the resulting formulations was clear and homogeneous.

Examples identified by number are examples of the present invention and those identified by letter are comparative examples.

KV40 is kinematic viscosity at 40° C. KV100 is kinematic viscosity at 100° C. KV0 is kinematic viscosity at 0° C. VI is viscosity index.

Grp IV-3 Base Oil Formulations

Table 2 describes Comparative Examples (Comp Exs) and Examples (Exs) comprising primarily Grp IV-3 base oil. Blending in the methyl capped OSPs results in a dramatic increase in viscosity index over the base oil alone, which has a VI of 147. The methyl capped OSPs also induce a low KV0.

Grp IV-4 Base Oil Formulations

Table 3 describes Comp Exs and Exs comprising primarily Grp IV-4 base oil. Blending in the methyl capped OSPs results in a comparable VI to the Grp IV base oil with a lower KV0 than the other blends or the hydrocarbon base oil.

TABLE 3

| | Weight Percent in Example | | | | |
|---|---|---|---|---|---|
| Oil | G | H | I | 7 | 8 |
| Grp IV-4 | 75 | 75 | 75 | 75 | 75 |
| Grp IV-2 | 25 | 0 | 0 | 0 | 0 |
| OSP-18 | 0 | 25 | 0 | 0 | 0 |
| Grp III-1 | 0 | 0 | 25 | 0 | 0 |

TABLE 2

| | Weight Percent in Example | | | | | | | | | | | |
|---|---|---|---|---|---|---|---|---|---|---|---|---|
| Oil | A | B | 1 | 2 | C | D | 3 | 4 | E | F | 5 | 6 |
| Grp IV-3 | 90 | 90 | 90 | 90 | 75 | 75 | 75 | 75 | 50 | 50 | 50 | 50 |
| Grp IV-2 | 10 | 0 | 0 | 0 | 25 | 0 | 0 | 0 | 50 | 0 | 0 | 0 |
| OSP-18 | 0 | 10 | 0 | 0 | 0 | 25 | 0 | 0 | 0 | 50 | 0 | 0 |
| OSP-AC | 0 | 0 | 10 | 0 | 0 | 0 | 25 | 0 | 0 | 0 | 50 | |
| OSP-BC | 0 | 0 | 0 | 10 | 0 | 0 | 0 | 25 | 0 | 0 | 0 | 50 |
| | Formulation Properties | | | | | | | | | | | |
| KV40, cSt | 258 | 237 | 219 | 222 | 159 | 136 | 121 | 121 | 69.7 | 63.5 | 49.4 | 45.6 |
| KV100, cSt | 28.8 | 27.4 | 26.8 | 26.9 | 20.3 | 18.4 | 17.6 | 17.7 | 11.2 | 10.4 | 9.37 | 9.07 |
| KV0, cSt | 3240 | 2850 | 2631 | 2575 | 1731 | 1424 | 1146 | 1118 | 587 | 594 | 375 | 308 |
| VI | 148 | 150 | 157 | 156 | 148 | 152 | 160 | 163 | 154 | 152 | 176 | 185 |

TABLE 3-continued

| Oil | Weight Percent in Example | | | | |
|---|---|---|---|---|---|
| | G | H | I | 7 | 8 |
| OSP-AC | 0 | 0 | 0 | 25 | 0 |
| OSP-BC | 0 | 0 | 0 | 0 | 25 |
| Formulation Properties | | | | | |
| KV40, cSt | 430 | 353 | 408 | 325 | 309 |
| KV100, cSt | 45.9 | 40.2 | 43.2 | 39.1 | 38.2 |
| KV0, cSt | 6027 | 4787 | 5400 | 3926 | 3468 |
| VI | 164 | 166 | 160 | 172 | 175 |

Grp IV-6 Base Oil Formulations

Table 4 describes Comp Exs and Exs comprising primarily Grp IV-6 base oil. Blending in the methyl capped OSPs results in a lower KV0 than the hydrocarbon blends

TABLE 4

| Oil | Weight Percent in Example | | | |
|---|---|---|---|---|
| | J | K | 9 | 10 |
| Grp IV-6 | 75 | 75 | 75 | 75 |
| Grp IV-2 | 25 | 0 | 0 | 0 |
| OSP-18 | 0 | 25 | 0 | 0 |
| OSP-AC | 0 | 0 | 25 | 0 |
| OSP-BC | 0 | 0 | 0 | 25 |
| Formulation Properties | | | | |
| KV40, cSt | 153 | 149 | 126 | 118 |
| KV100, cSt | 19.9 | 19.6 | 18.1 | 17.4 |
| KV0, cSt | 1621 | 1749 | 1239 | 1077 |
| VI | 150 | 151 | 160 | 162 |

Grp IV-7 Base Oil Formulations

Table 5 describes Comp Exs and Exs comprising primarily Grp IV-7 base oil. Blending in the methyl capped OSPs results in a lower KV0 than the hydrcoarbon blends

TABLE 5

| Oil | Weight Percent in Example | | | |
|---|---|---|---|---|
| | L | M | 11 | 12 |
| Grp IV-7 | 75 | 75 | 75 | 75 |
| Grp IV-2 | 25 | 0 | 0 | 0 |
| OSP-18 | 0 | 25 | 0 | 0 |
| OSP-AC | 0 | 0 | 25 | 0 |
| OSP-BC | 0 | 0 | 0 | 25 |
| Formulation Properties | | | | |
| KV40, cSt | 241 | 218 | 231 | 215 |
| KV100, cSt | 28.6 | 32.6 | 33.3 | 32.1 |
| KV0, cSt | 2483 | 2014 | 2170 | 1840 |
| VI | 156 | 195 | 190 | 194 |

Grp IV-9 Base Oil Formulations

Table 6 describes Comp Exs and Exs comprising primarily Grp IV-7 base oil. Blending in the methyl capped OSPs results in a lower KV0 and higher VI than the other blends

TABLE 6

| Oil | Weight Percent in Example | | | |
|---|---|---|---|---|
| | O | P | 13 | 14 |
| Grp IV-9 | 75 | 75 | 75 | 75 |
| Grp IV-2 | 25 | 0 | 0 | 0 |
| OSP-18 | 0 | 25 | 0 | 0 |

TABLE 6-continued

| Oil | Weight Percent in Example | | | |
|---|---|---|---|---|
| | O | P | 13 | 14 |
| OSP-AC | 0 | 0 | 25 | 0 |
| OSP-BC | 0 | 0 | 0 | 25 |
| Formulation Properties | | | | |
| KV40, cSt | 181 | 173 | 157 | 146 |
| KV100, cSt | 25.5 | 24.7 | 24.0 | 23.1 |
| KV0, cSt | 1600 | 1651 | 1325 | 1173 |
| VI | 175 | 175 | 185 | 189 |

Grp IV-3 Base Oil Formulations in Fully Formulated Industrial Gear Oil

Table 7 describes Comp Exs and Exs comprising primarily Grp IV-3 base oil blended with typical additives to achieve a typical Industrial Gear Oil. Blending in the methyl capped OSPs results in a higher viscosity index and as the amount of OSP increases a lower low temperature viscosity.

Irganox is a trademark of BASF SE Company. Ortholeum is a trademark of Innospec International Limited Corporation. Vanlube is a trademark of Vanderbilt Minerals, LLC.

TABLE 7

| Oil | Weight Percent in Example | | | |
|---|---|---|---|---|
| | 15 | Q | 16 | R |
| Grp IV-3 | 72 | 72 | 57 | 57 |
| OSP-18 | 0 | 10 | 0 | 25 |
| OSP-AC | 10 | 0 | 25 | 0 |
| Grp III-1 | 15.35 | 15.35 | 15.35 | 15.35 |
| Irganox ™ L101 | 0.75 | 0.75 | 0.75 | 0.75 |
| Irganox ™ L57 | 1 | 1 | 1 | 1 |
| Ortholeum ™ 535 | 0.75 | 0.75 | 0.75 | 0.75 |
| Vanlube ™ 9123 | 0.15 | 0.15 | 0.15 | 0.15 |
| Formulation Properties | | | | |
| KV40, cSt | 159 | 144.38 | 93.82 | 93.36 |
| KV100, cSt | 20.5 | 18.93 | 14.24 | 13.82 |
| KV0, cSt | 1919 | 1529.4 | 866.53 | 933.63 |
| VI | 151 | 148.7 | 156.5 | 150.8 |

The invention claimed is:

1. An industrial base oil formulation comprising a base oil having a kinematic viscosity of more than 100 centiStokes at 40 degrees Celsius and an alkyl capped oil soluble polymer additive being present in a range of five to twenty-five weight-percent based on the total combined weight of the alkyl capped oil soluble polymer additive and the base oil, where the alkyl capped oil soluble polymer additive consists of an alkyl capped oil soluble polymer additive having the structure of Formula I:

$$R^1[O(R^2O)_n(R^3O)_mR^4]_p \quad (I)$$

where $R^1$ is an alkyl having from one to thirty carbons, $R^2$ and $R^3$ are independently selected from alkyls having three or four carbons and can be in block form or randomly combined, $R^4$ is an alkyl having from one to 18 carbon atoms, n and m are independently numbers ranging from zero to 20 provided that n+m is greater than zero and p is a number within a range of one to three, wherein the industrial base oil formulation has a kinematic viscosity of greater than 100 centiStokes at 40 degrees Celsius and a viscosity index of 130 or higher.

2. The industrial base oil formulation of claim 1, wherein the base oil is a hydrocarbon oil.

3. The industrial base oil formulation of claim 2, wherein the base oil is a polyalphaolefin.

4. The industrial base oil formulation of claim 1, wherein the base oil is further characterized by having a kinematic viscosity at of 150 centiStokes or higher at 40 degrees Celsius.

5. The industrial base oil formulation of claim 1, wherein the alkyl capped oil soluble polymer additive is a random copolymer of 1,2-butylene oxide and 1,2-propylene oxide.

6. The industrial base oil formulation of claim 1, further characterized by $R^4$ being a methyl group.

7. The industrial base oil formulation of claim 1, further characterized by p being one.

8. The industrial base oil formulation of claim 1, further characterized by $R^1$ being an alkyl having from eight to twelve carbons.

9. A method for increasing the viscosity index of a polyalphaolefin base oil having a kinematic viscosity of more than 100 cSt at 40 degrees Celsius while simultaneously decreasing the viscosity of the polyalphaolefin base oil at a temperature of zero degrees Celsius, the method comprising blending into the polyalphaolefin base oil an AC-OSP additive being present in a range of five to twenty-five-weight-percent based on the total combined weight of the AC-OSP additive and the base oil, where the AC-OSP additive consists of a AC-OSP having the structure of Formula I:

$$R^1[O(R^2O)_n(R^3O)_mR^4]_p \quad (I)$$

where $R^1$ is an alkyl having from one to thirty carbons, $R^2$ and $R^3$ are independently selected from alkyls having three or four carbons, $R^4$ is an alkyl having from one to 18, n and m are independently selected from numbers ranging from one to 20 provided that n+m is greater than zero and p is a number within a range of one to three so as to achieve the industrial base oil formulation of claim 1.

10. A method for lubricating a mechanical device comprising multiple parts that move with respect to one another, the method comprising introducing a lubricant containing the industrial base oil formulation of claim 1 into the mechanical device so as to access interstices between the parts that move with respect to one another.

11. The industrial base oil formulation of claim 1, wherein the alkyl capped oil soluble polymer additive has a molecular weight of from about 200 grams per mole (g/mol) to about 700 g/mol.

12. The industrial base oil formulation of claim 1, wherein the alkyl capped oil soluble polymer additive is present in a range of 10 to 50 weight-percent based on the total combined weight of the alkyl capped oil soluble polymer additive and the base oil.

13. The industrial base oil formulation of claim 1, wherein the alkyl capped oil soluble polymer additive is present in a range of 10 to 25 weight-percent based on the total combined weight of the alkyl capped oil soluble polymer additive and the base oil.

14. The industrial base oil formulation of claim 1, wherein the industrial base oil formulation has a kinematic viscosity in a range from to 100 to 325 centiStokes at 40 degrees Celsius and a viscosity index in range of 130 to 194.

* * * * *